US006138600A

United States Patent [19]

Berquist

[11] Patent Number: 6,138,600

[45] Date of Patent: Oct. 31, 2000

[54] DECK OR DOCK FLOAT

[75] Inventor: Tomm A. Berquist, Coon Rapids, Minn.

[73] Assignee: Aggressive Industries, Inc., Spring Lake Park, Minn.

[21] Appl. No.: 09/456,843

[22] Filed: Dec. 7, 1999

[51] Int. Cl.[7] ..... B63B 35/44

[52] U.S. Cl. ..... 114/267; 405/219

[58] Field of Search ..... 114/263, 264, 114/267; 405/219

[56] References Cited

U.S. PATENT DOCUMENTS

| | | | |
|---|---|---|---|
| 3,964,221 | 6/1976 | Berquist | 52/117 |
| 4,418,634 | 12/1983 | Gerbus | 114/263 |
| 5,048,448 | 9/1991 | Yoder | 114/263 |
| 5,050,524 | 9/1991 | Kyhl et al. | 114/263 |
| 5,199,370 | 4/1993 | Berquist | 114/263 |
| 5,281,055 | 1/1994 | Neitzke et al. | 405/219 |

*Primary Examiner*—Jesus D. Sotelo
*Attorney, Agent, or Firm*—James R. Cwayna

[57] ABSTRACT

A float which may be utilized individually or which may be joined to other such floats or used with other elements to provide flotation for a deck or dock unit. Though the particular shapes and attributes of the float may vary for the particular use, the basic float consists of a hollow, preferably rotocast, unit which combines an exterior skin with attachment accommodations having a selectable top surface and a first and second flotation concept. The first flotation is provided by the buoyancy of the hollow structure with the second achieved through a plurality of selectively shaped and positioned cavities extending upwardly from the bottom surface of the float to a location at or adjacent the upper surface of the float. With this dual flotation provision, should the exterior skin of the float be pierced, allowing water to fill the interior thereof, flotation is provided by air entrapment within the formed cavities. The float provides for selective upper surface arrangements dependent upon the desire of the user and may include a flat, or otherwise formed surface.

5 Claims, 4 Drawing Sheets

DECK OR DOCK FLOAT

RELATED APPLICATIONS

Applicant has no applications currently on file with the United States Patent and Trademark Office which should be considered in association with the prosecution of this application and is not aware of any pending applications by others which should be so considered.

SPONSORSHIP

This application is not made under either any Federal or other sponsorship and is the result of the sole effort of the Applicant.

FIELD OF THE INVENTION

This invention relates generally to water floats and the like and more specifically to a float which may be combined with other similar floats to provide a floating dock, deck surface or support for a deck surface and which is specifically designed to provide two considerations for maintaining flotation which include both a sealed, floating unit and a plurality of air entrapping cavities formed in the bottom surface of such a unit such that if the seal should be broken or a surface of the same be broken or pierced, air entrapment cavities will maintain the unit in buoyed condition.

SHORT SUMMARY OF THE INVENTION

A dock or deck float providing an upper surface, downwardly depending sides and a bottom surface, all of which are sealingly joined or formed together to provide an air confining cavity with the bottom surface being provided with a plurality of upwardly directed cavities which terminate either in close proximity to or at the upper surface.

The upper surface of the float may be flat or may include downwardly directed recesses to receive elements therein to assist in connecting similar floats to one another or which may provide a selected upper surface to either a singular or joined float structure. Certain of the sides may be formed with indentations to receive connective units which allow for side-to-side joinder of similar units.

The bottom of the float is provided with a plurality of selectively shaped and sized cavities which extend upwardly from the bottom to the top surface or are in close proximity thereto and which serve as air-entrapping cavities which provide a second buoyancy factor to the float and which will be effective to maintain buoyancy should the float become punctured or otherwise have its skin broken to take on water.

BACKGROUND AND OBJECTS OF THE INVENTION

Float units are utilized in a plurality of applications. These may include total, joined dock or float structures or spaced units which are spanned and joined by support elements such as dock upper surfaces which provide walkways.

Most such float units are foam or buoyancy material additive filled and this creates a particularly heavy unit with increased manufacturing costs due to the material addition.

Applicant provides a float unit for such decks or docks which provides a dual buoyancy feature while maintaining a desired light weight for the unit as well as a less expensive unit by eliminating the filling additive.

With the Applicant's float, a hollow, continuous and thus sealed structure is provided which includes a plurality of selectively sized cavities extending upwardly from the bottom surface thereof which cavities serve as air entrapment areas such that, should the surface of the structure be damaged and allow water entrance, the cavities provide buoyancy to maintain the unit in floating condition.

It is therefore an object of the Applicant's invention to provide a float unit for decks or docks which includes a hollow, bloating body to provide a first element of flotation.

It a further object of the Applicant's invention to provide a float unit for decks or docks which includes at least one flotation additive cavity extending upwardly from the bottom surface thereof to serve as an air entrapment area to provide a second element of flotation for the unit.

It is a further object of the Applicant's invention to provide a float unit for decks or docks with a selected upper surface which may provide a continuous support surface or which may be provided with recessed areas to receive elements for support or connective elements.

It is a further object of the Applicant's invention to provide a float unit for decks or docks which is provided with attachment areas about the exterior thereof for side-to-side connection of multiples of such units.

These and other objects and advantages of the Applicant's invention will more fully appear from the accompanying drawings and description.

DESCRIPTION OF A PREFERRED FORM OF THE INVENTION

Figure 1:
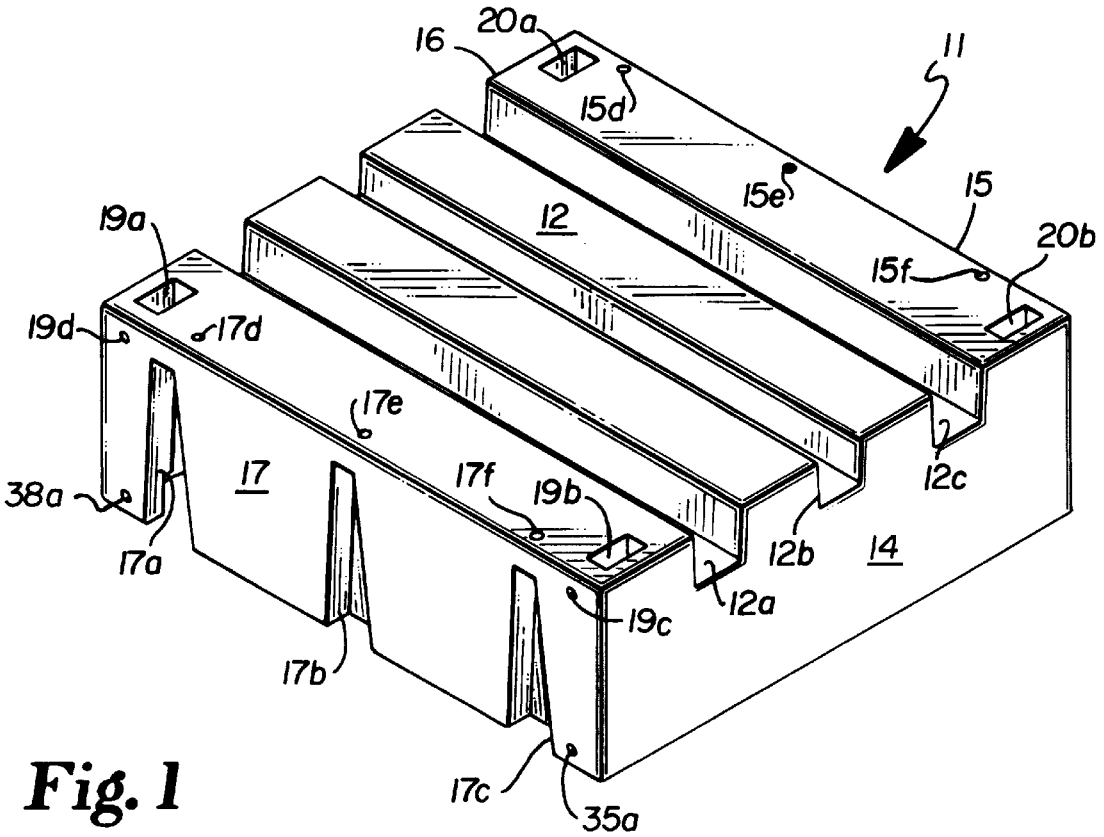
FIG. 1 is a top perspective view of a float unit embodying the concepts of the Applicant's invention.
Figure 2:
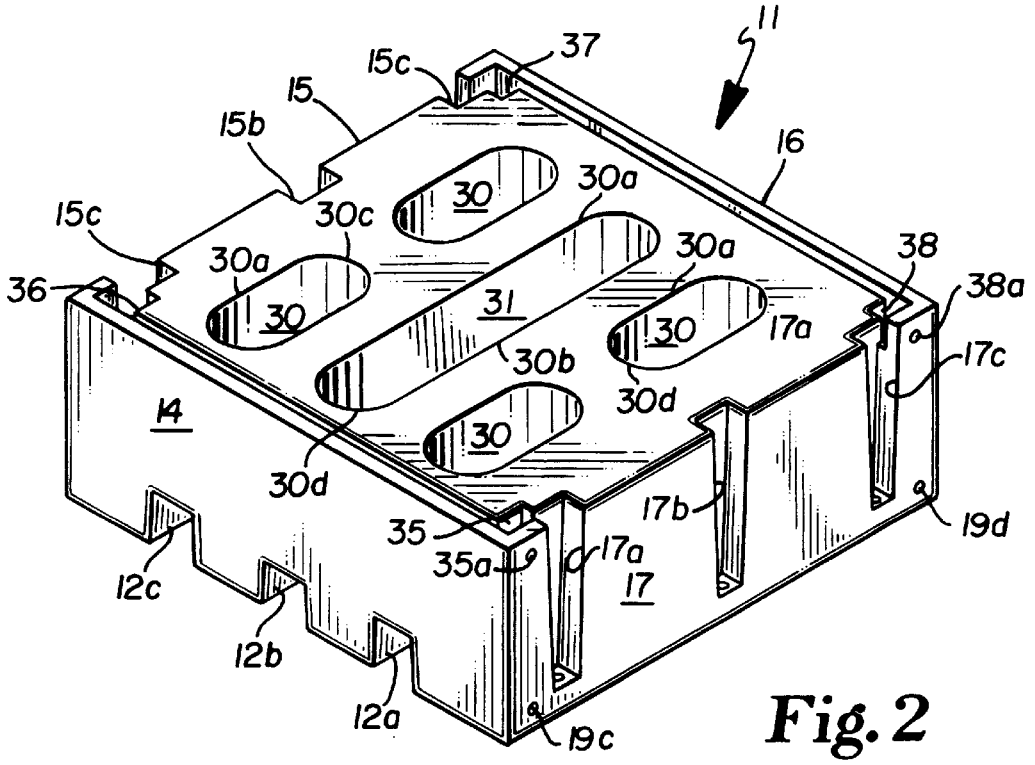
FIG. 2 is a bottom perspective view thereof.
Figure 8:
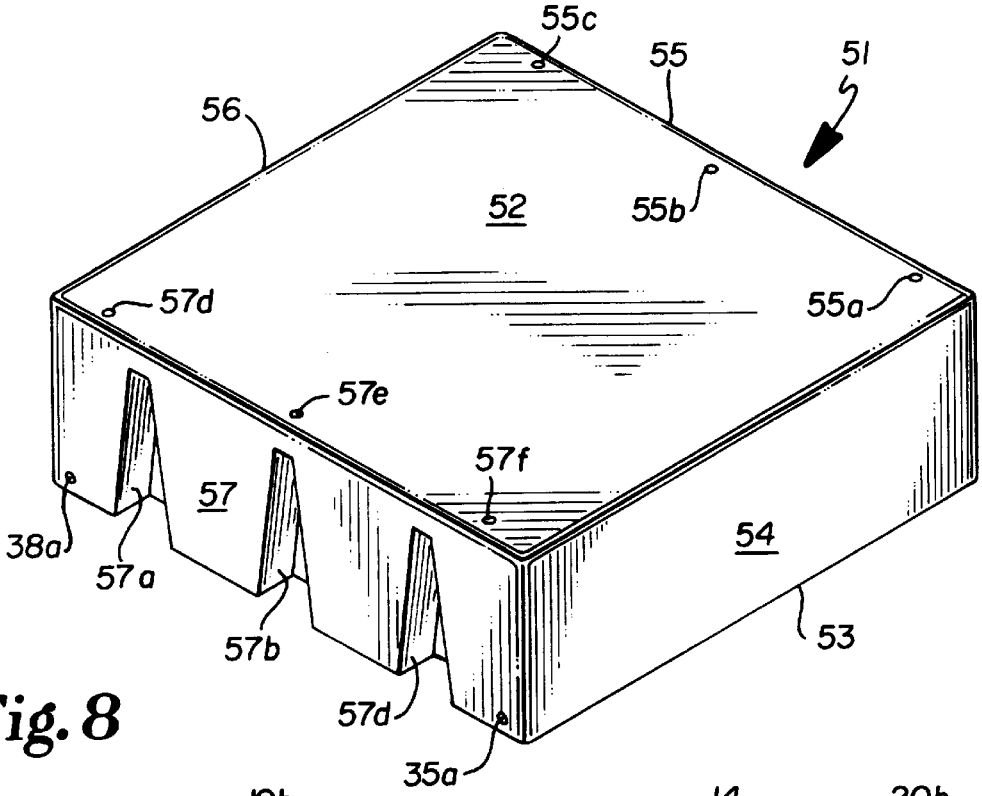

In accordance with the accompanying drawings, the float unit embodying the concepts of the Applicant's invention is generally designated 11 in FIG. 1 and as 51 in FIG. 8 with the various sections shown in the various views being applicable to both forms.

As illustrated in FIGS. 1 and 8, the units 11 and 51 include a generally rectangular top 12, bottom 13 and downwardly extending sides 14, 15, 16, 17 and in FIG. 8 as top 52, bottom 53 and downwardly extending sides 54, 55, 56, 57.

The form illustrated in FIG. 1 will be initially described.

In FIG. 1, top 12 is provided with a plurality of spaced, generally rectangular recesses of which three are illustrated 12*a*, 12*b*, 12*c* extending entirely across the unit and which may be selectively utilized as receptacles for joinder elements extending between successive units or which may be utilized as receptacles for supply lines such as power, gasoline or the like.

As illustrated these recesses 12*a*, 12*b*, 12*c* are arranged in a single, parallel direction on such upper surface 12 but other arrangements obviously are available.

Two sides 15 and 17 of the unit 11 are provided with cavities 15*a*, 15*b*, 15*c* and 17*a*, 17*b*, 17*c* extending upwardly from the bottom 13 and these areas are defined as being frusto-pyramidal in shape defined by three sides which taper upwardly from the bottom 13 to terminate adjacent top or upper surface 12. As illustrated communicating passages 15*d*, 15*e*, 15*f*, 17*d*, 17*e*, 17*f* extend downwardly from top 12 to such cavities to provide for the passage of elements, such as attachment elements from the cavity areas upwardly to the top surface 12. Various elements may be attached through these apertures and may include connectors (not shown) to join two units 11 together.

Additional formed depressions or indentations 19*a*, 19*b*, 20*a* and 20*b* are provided through the top surface 12 a predetermined depth and attachment element receiving passages 19*c*, 19*d*, 20*d*, 20*c* extend through, at least sides 15 and 17 to communicate with the indentations 19*a*, 19*b*, 20*a*, 20*b* to receive an attachment element therethrough for additional side-to-side attachment of units 11.

As shown in the various cross sections, the unit 11 is of a hollow, relatively thin wall construction such as may be obtained by roto-casting in which material is provided into a female mold, the mold is heated and rotated through a plurality of axis while being heated which causes the material to melt, solidify and adhere to the interior walls of the mold. Simply governing the amount of material placed into the mold will establish the wall thickness and definition of all of the aforementioned passages and receiving areas is easily accomplished. This method then establishes a continuous hollow structure to provide the first aspect of flotation to the unit.

Figure 3:
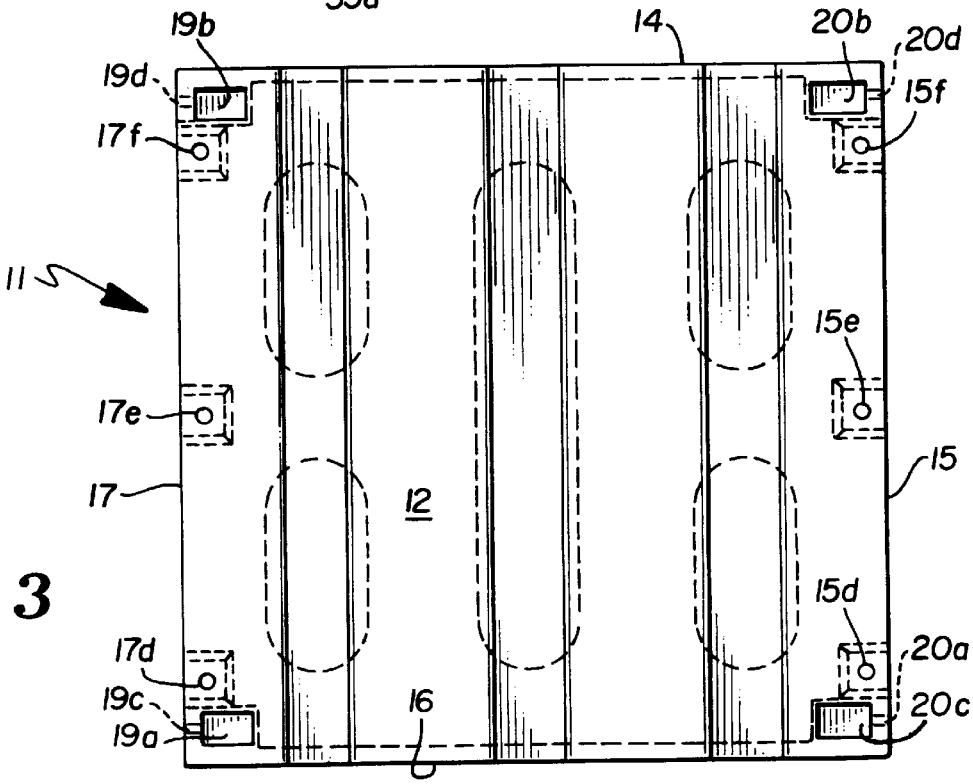
FIG. 3 is a top view thereof with dotted lines illustrating the bottom surface thereof.
Figure 4:
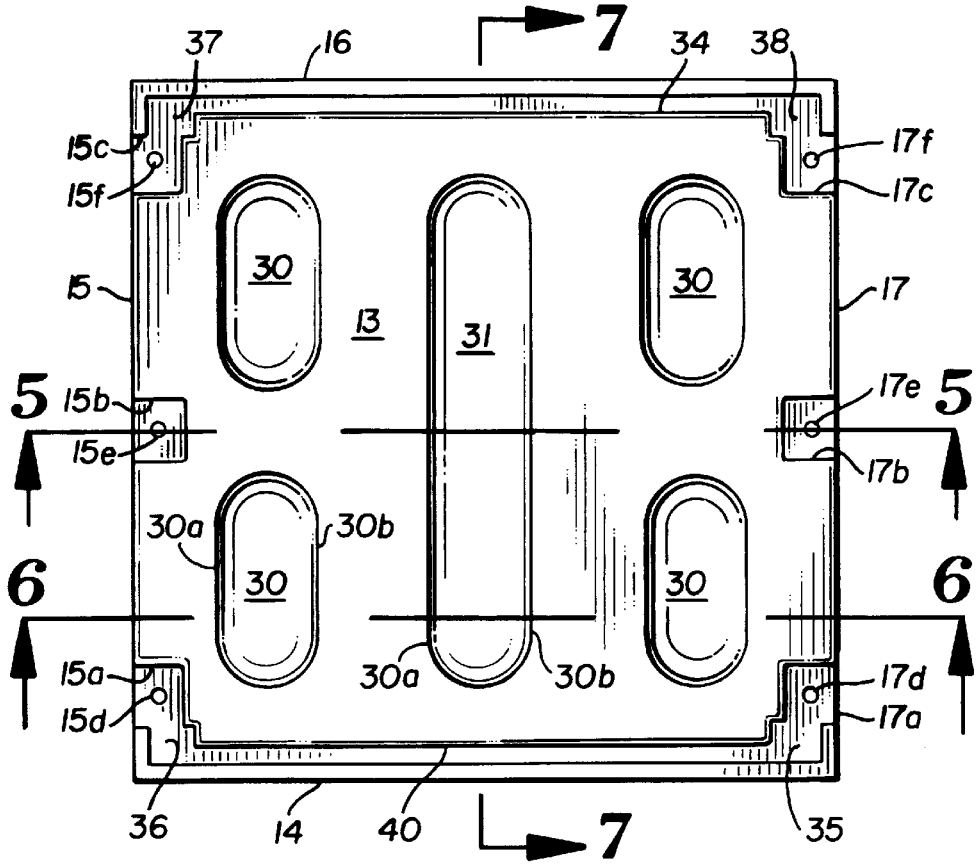
FIG. 4 is a bottom plan view thereof.
Figure 5:
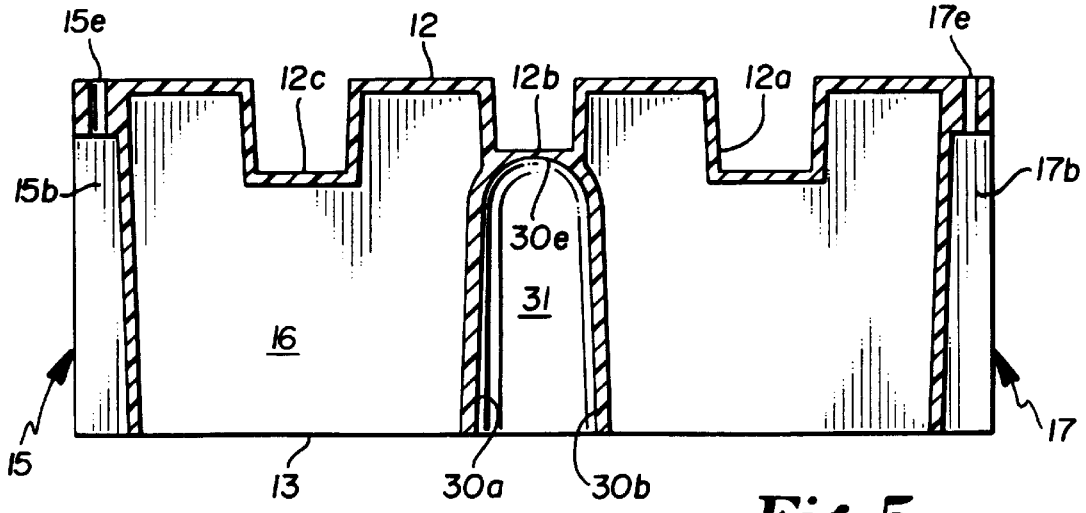
FIG. 5 is a vertical section taken substantially along Line 5—5 of FIG. 4.
Figure 6:
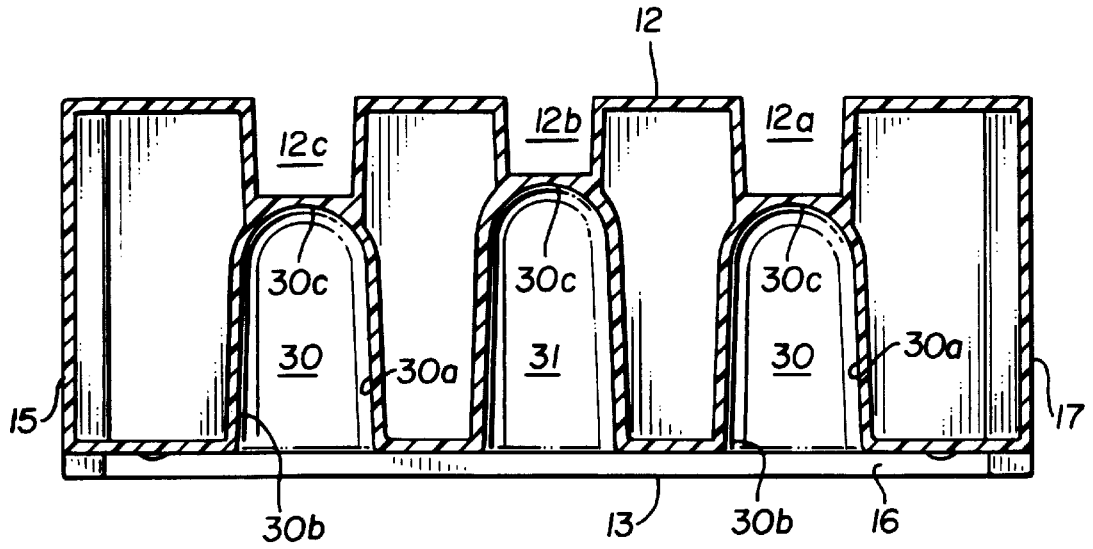
FIG. 6 is a vertical section taken substantially along Line 6—6 of FIG. 4.
Figure 7:
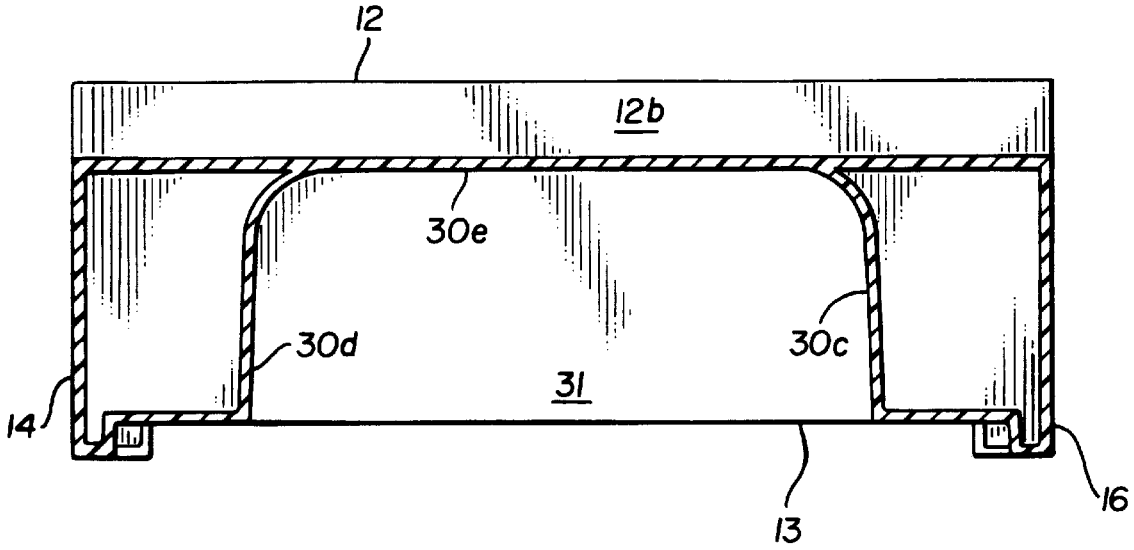
FIG. 7 is a vertical section taken substantially along Line 7—7 of FIG. 3; and, FIG. 8 is a top perspective view of a modified version of the unit having a selective top surface.

The aspect of obtaining the second flotation attribute of the applicant's invention is illustrated in the various views which are directed to the bottom of the unit and FIG. 3 which is a top plan view but which illustrates the various cavities of the bottom 13 in dotted lines.

As illustrated, a plurality of upwardly directed, air retaining cavities 30, 31 are provided and the indicia differential is only to distinguish between the sizing, although not the shape, of the cavities. As also illustrated in the cross sections, these cavities 30, 31 are formed upwardly from the bottom 13 of the unit 11 and terminate at or near the underside of the upper surface of the top 12. As illustrated in the views, the upper ends of the cavities 30, 31 may be in close proximity to the recessed areas 12*a*, 12*b*, 12*c* of the top 12 but this is a matter of choice and does not limit this disclosure to a specific location nor number of such cavities.

In analysis of any of the cavities 30, 31, each of them defines an opening in bottom surface 13 consisting of a pair of parallel sides 30*a*, 30*b* which sides terminate in a joining semi-circular end 30*c*, 30*d* with all of these elements 30*a*, 30*b*, 30*c* and 30*d* extending upwardly from bottom 13. The upwardly extending sides 30*a*, 30*b* and semi-circular ends 30*c*, 30*d* taper inwardly and upwardly to a dual, hemispherical top 30*e*. Applicant has found that the particular shape described and illustrated will provide for an effective internal support and provide a maximum amount of air entrapment area for the second flotation aspect.

Other features of the bottom 13 include indentations or depressions of a predetermined depth 35, 36, 37, 38 arranged adjacent to the cavities 15*c*, 15*a*, 17*c*, 17*d*. Attachment passages 35*a*, 36*a*, 37*a* and 38*a* extend through sides 15, 17 to receive attachment elements therethrough. Additional passages could be formed through sides 14, 16 to also communicate with such indentations or depressions.

In addition to the flotation cavities 30,31 and indentations or depressions 35, 36, 37, 38 a pair of grooves 39, 40 may be provided along sides 14, 16.

A flat top form of the invention is illustrated in FIG. 8. As shown therein, the unit 51 includes a flat top 52, a bottom 53 having the same cavities, depressions, etc. discussed and illustrated and sides 54, 55, 56, 57 to again form a hollow unit again having the relatively thin outer surfaces as illustrated in the accompanying sections of the drawings. The upwardly directed cavities are identical to those illustrated and described in association with the previous description. The unit 51 also provides the frusto-pyramidical connective recesses 57*a*, 57*b*, 57*c*, having communicating passages 57*d*, 57*e*, 57 formed through the top 52. These connective recesses also are provided on side 55 and only the communicating passages 55*d*, 55*e* and 55*f* appear in this view.

The units 11, 51 then are identical to each other with the primary difference being in the upper surfaces thereof but each has the attachment features and flotation feature of being hollow and the air entrapment concepts.

It should be obvious that the Applicant has provided a new and unique dock or deck float providing features for a plurality of connective arrangements and will provide a water stable unit.

What is claimed is:

1. A deck or dock float including:

a) a hollow body member having a top, downwardly directed sides and a bottom to provide a first buoyancy aspect;

b) at least one air retaining cavity extending upwardly from said bottom and terminating adjacent the underside of said top to provide a second buoyancy aspect;

c) said air retaining cavity including;

1) an opening in said bottom having generally parallel sides joined at the ends thereof;

2) upwardly directed and inwardly tapered side walls;

3) a generally rounded top;

d) at least one indentation formed in said top adjacent a corner thereof and extending downwardly a predetermined distance; and, e) at least one connective element receiving passage formed through an adjacent side of the float.

2. The dock or deck float as set forth in claim 1 and said indentations provide in all corners thereof and connective element receiving passages formed through adjacent sides of the float.

3. The dock or deck float as set forth in claim 1, wherein a) the ends of said parallel bottom opening are joined through a semi-circular wall.

4. The dock or deck float as set forth in claim 1, including:

a) at least one indentation formed in said bottom adjacent a corner thereof and extending upwardly a predetermined distance; and, b) at least one connective element receiving passage formed through an adjacent side of the float.

5. The dock or deck float as set forth in claim 4, including:

a) and at least one indentation being provided in all corners thereof and connective element receiving passages formed through adjacent sides of the float.

* * * * *